US009095963B2

(12) United States Patent
Huang

(10) Patent No.: US 9,095,963 B2
(45) Date of Patent: Aug. 4, 2015

(54) AUXILIARY TOOL FOR TIMING GEAR

(71) Applicant: POUL CHANG METAL INDUSTRY CO., LTD., Taichung (TW)

(72) Inventor: Chia-Hao Huang, Taichung (TW)

(73) Assignee: POUL CHANG METAL INDUSTRY CO., LTD., Taichung (TW)

( * ) Notice: Subject to any disclaimer, the term of this patent is extended or adjusted under 35 U.S.C. 154(b) by 293 days.

(21) Appl. No.: 13/889,895

(22) Filed: May 8, 2013

(65) Prior Publication Data

US 2014/0331832 A1 Nov. 13, 2014

(51) Int. Cl.

| | |
|---|---|
| ***B25B 27/00*** | (2006.01) |
| ***B25B 27/14*** | (2006.01) |
| *B25B 23/00* | (2006.01) |

(52) U.S. Cl.

CPC ..... *B25B 27/0035* (2013.01); *B25B 27/14* (2013.01); *B25B 23/0085* (2013.01)

(58) Field of Classification Search

CPC .. B25B 27/0035; B25B 27/14; B25B 27/0085
See application file for complete search history.

(56) References Cited

U.S. PATENT DOCUMENTS

| | | | | |
|---|---|---|---|---|
| 6,332,256 | B1 * | 12/2001 | Dawson | 29/281.5 |
| 7,055,230 | B2 * | 6/2006 | Wu | 29/281.5 |
| 8,307,527 | B2 * | 11/2012 | Huang | 29/281.5 |

* cited by examiner

*Primary Examiner* — David B Thomas
(74) *Attorney, Agent, or Firm* — Muncy, Geissler, Olds & Lowe, P.C.

(57) ABSTRACT

An auxiliary tool for timing gear for use with a wrench to mount or dismount a timing gear is disclosed to include a support member having a stop rod at its one end, a movable device slidably mounted in the support member and providing a stem at its one end for working with the stop rod to engage into peripheral notches of the timing gear at two opposite sides during application, and a handle pivotally coupled to the support member and defining therein a longitudinally extending limit slot for accommodating one end of the movable device to limit pivoting movement between the support member and the handle within a predetermined range.

10 Claims, 9 Drawing Sheets

AUXILIARY TOOL FOR TIMING GEAR

BACKGROUND OF THE INVENTION

1. Field of the Invention

The present invention relates to hand tool technology and more particularly, to an auxiliary tool for use with a wrench to mount or dismount a timing gear.

2. Description of the Related Art

U.S. Pat. No. 7,069,821 discloses a hand tool entitled "Movable jaw type holding device", which includes a handle 11 having a fixed jaw member 12 holding a first rod member 121, a movable jaw member 20 pivoted to the handle 11 by a pivot and holding a second rod member 221 corresponding to the first rod member 121, a spring member 30 stopped between the handle 11 and the movable jaw member 20 to keep the movable jaw member 20 apart from the fixed jaw member 12. Thus, when operating the movable jaw type holding device to dismount a screw bolt from the wheel 40;50, the first and second rod members of the movable jaw type holding device stop the wheel from rotation with the screw bolt. Further, this design of movable jaw type holding device is suitable for applicable to different sizes of wheels 40;50.

Further, as illustrated in FIG. 7 in the specification of the aforesaid prior art design, the fixed jaw member 12 and the movable jaw member 20 each also have a prod member 14;23 at the opposite side so that the movable jaw type holding device is operable in reversed directions.

However, when mounting the wheel 40;50, the movable jaw type holding device must be operated on the reversed side due to that the elastic member 30 keeps the movable jaw member 20 and the fixed jaw member 12 in an open condition during forward rotation of the wrench 42;52 to fasten tight the wheel bolt, and the second rod member 221 cannot be positively stopped against the wheel spokes 44. Thus, the user may need to reverse the movable jaw type holding device when performing a mounting or dismounting operation.

Further, a commercially available holding tool is known, as shown in FIGS. 1 and 2, comprising a tool body 1 defining a longitudinal sliding slot 3, a stop rod 2 transversely located at one end of the tool body 1, and a stop member 4 slidably mounted in the longitudinal sliding slot 3. The stop member 4 can be locked at any selected location within the longitudinal sliding slot 3 by a locknut thereof so that the stop rod 2 and the stop member 4 can be engaged into the peripheral notches 6 of the wheel 5 to prevent the wheel 5 from rotating when the user uses a wrench 7 to rotate the wheel bolt 8.

This commercial holding tool is operable in one single side to work with the wrench 7 in mounting or dismounting the wheel (timing gear) 5. However, when mounting or dismounting a different size of wheel (timing gear) 5, the user must loosen the locknut of the stop member 4 and then adjust the distance between the stop member 4 and the stop rod 2. After adjustment, the user must fasten tight the locknut of the stop member 4 to lock the stop member 4 in the adjusted position, bringing inconvenience.

SUMMARY OF THE INVENTION

The present invention has been accomplished under the circumstances in view. It is the main object of the present invention to provide an auxiliary tool for timing gear, which is practical for mounting and dismounting timing gears of different sizes without changing the operating direction of the tool.

To achieve this and other objects of the present invention, an auxiliary tool for timing gear in accordance with the present invention is adapted for use with a wrench to mount or dismount a timing gear, comprising a support member, a movable device and a handle. The support member comprises a transversely extending stop rod at its one, and a longitudinally extending sliding slot at its opposite end. The movable device is mounted in and movable along the sliding slot, s comprising a stem located at its one end and disposed in a parallel manner relative to the stop rod for working with the stop rod to engage into peripheral notches of a timing gear at two opposite sides during application. The handle is pivotally coupled to the support member, comprising a longitudinally extending limit slot for accommodating an opposite end of the movable device to limit pivoting movement between the support member and the handle within a predetermined range.

Preferably, the auxiliary tool for timing gear further comprises an elastic member, for example, tensile spring, connected between the support member and the movable device. Subject to the arrangement of the tensile spring, the distance between the stop rod and the stem is rapidly adjustable to fit timing gears of different sizes.

Further, the limit slot defines therein opposing first stop wall and second stop wall for selectively stopping against the stem. Thus, the auxiliary tool can effectively stop the timing gear from rotation when the user operates a wrench to rotate the screw bolt that locks the timing gear. Therefore, the auxiliary tool can be used to mount or dismount a timing gear without reversing its operating side.

Other advantages and features of the present invention will be fully understood by reference to the following specification in conjunction with the accompanying drawings, in which like reference signs denote like components of structure.

DETAILED DESCRIPTION OF THE INVENTION

Figure 1:
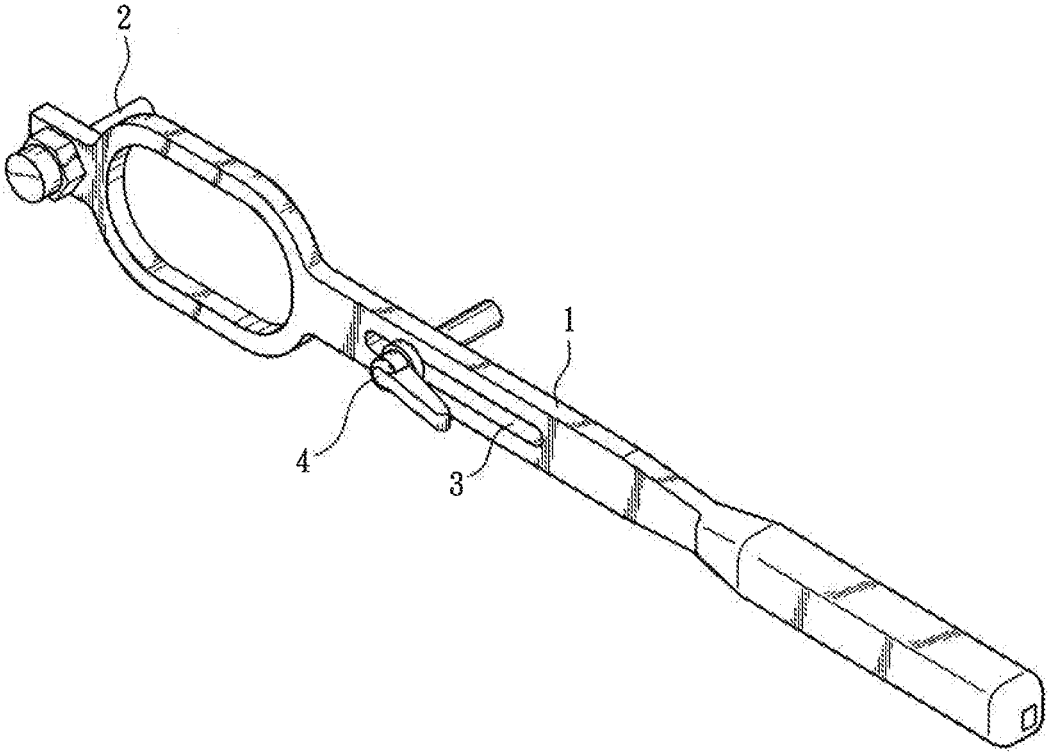
FIG. 1 is an elevational view of a holding tool according to the prior art.
Figure 2:
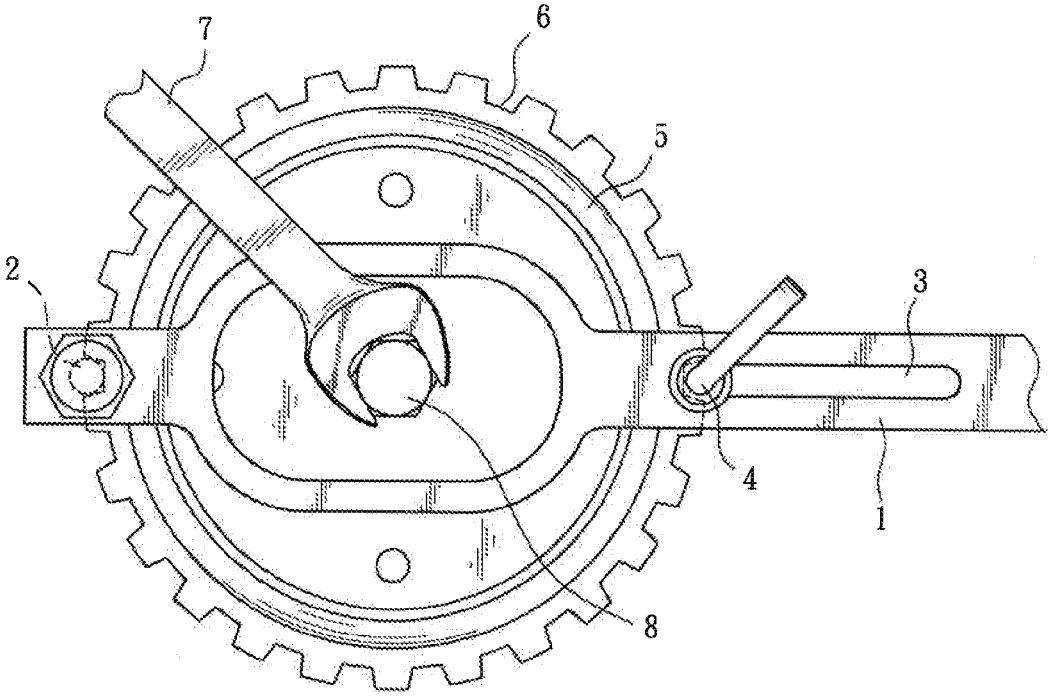
FIG. 2 is a schematic applied view of the holding tool according to the prior art.
Figure 3:
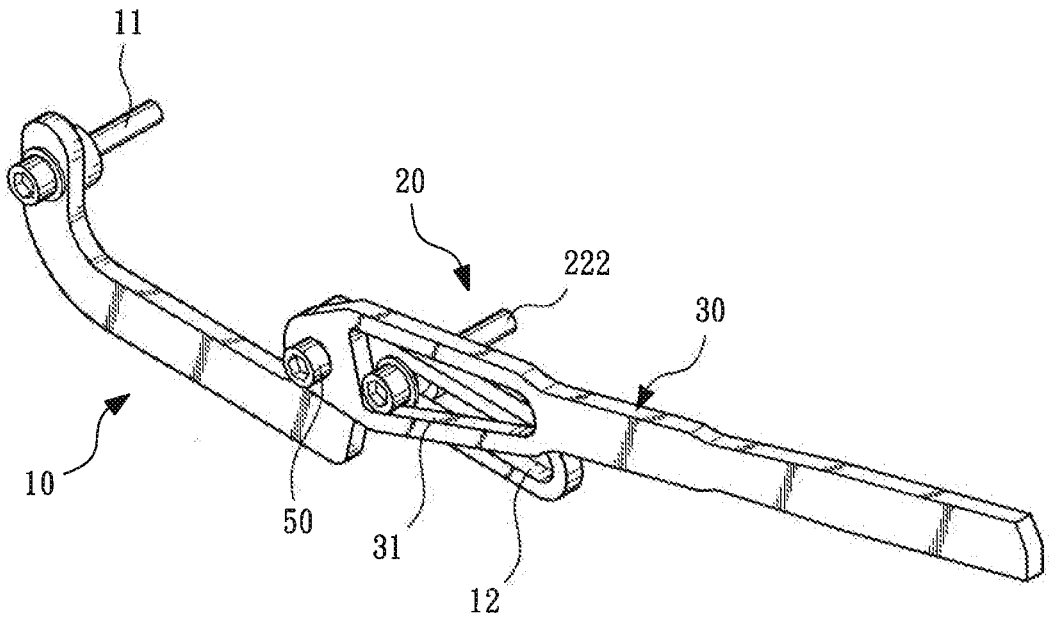
FIG. 3 is an oblique elevational view of an auxiliary tool for timing gear in accordance with the present invention.
Figure 4:
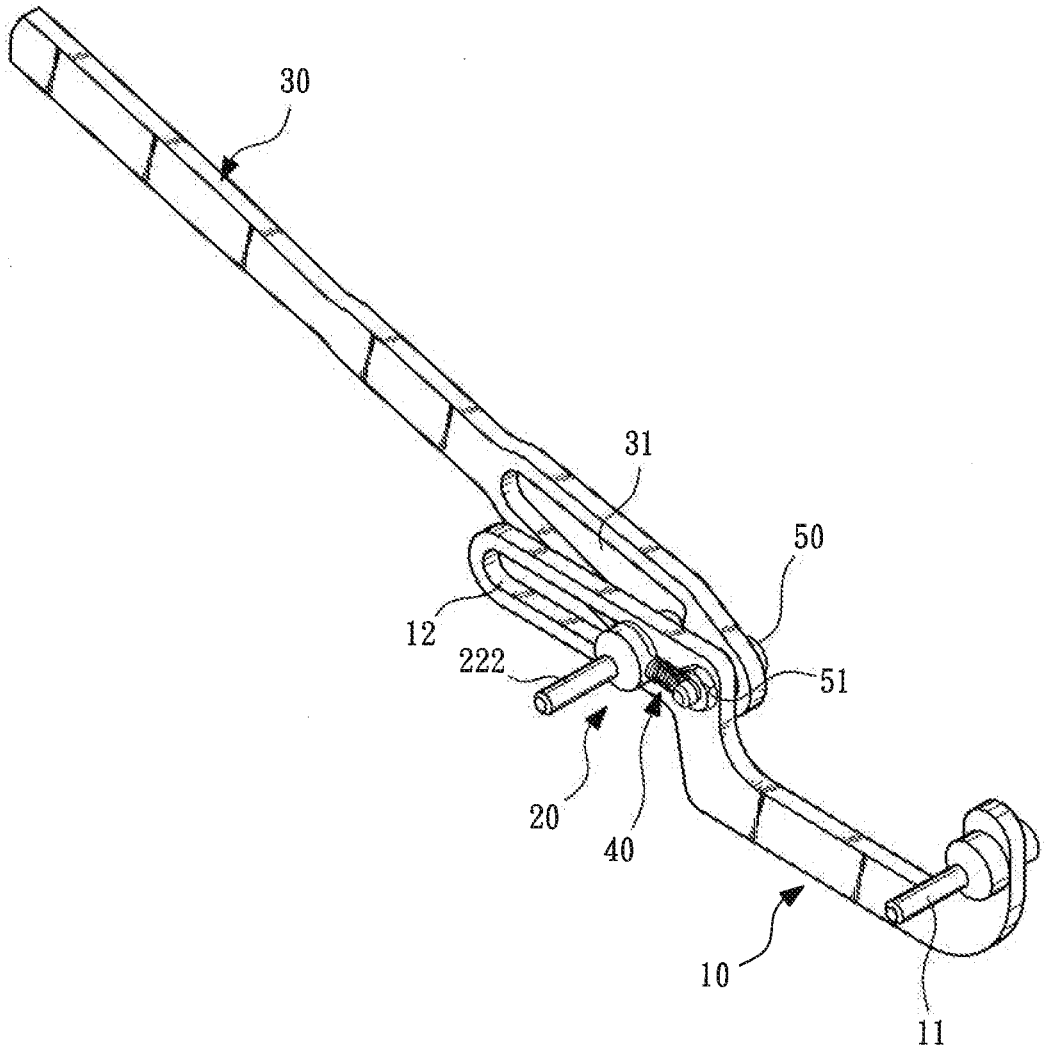
FIG. 4 corresponds to FIG. 3 when viewed from another angle.
Figure 5:
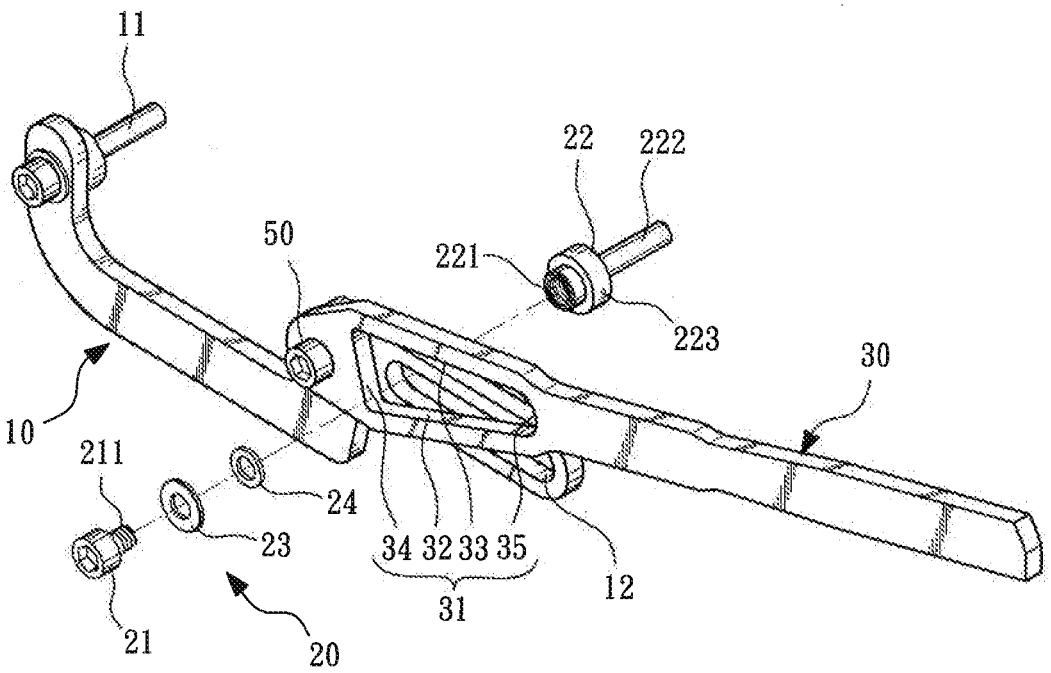
FIG. 5 is an exploded view of the auxiliary tool for timing gear in accordance with the present invention.

Referring to FIGS. 3-5, an auxiliary tool for timing gear in accordance with the present invention is shown. The auxiliary tool comprises a support member 10, a movable device 20, a handle 30, and an elastic member 40.

The support member 10 has a substantially C-shaped configuration, carrying a transversely extending stop rod 11 at its one end and defining a longitudinally extending sliding slot 12 at its other end.

The movable device 20 is mounted in and movable along the sliding slot 12 of the support member 10, comprising a first screw member 21, a second screw member 22, a washer 23, and a sliding member 24. The first connecting screw member 21 in this embodiment is a male screw member comprising a head 211 and a threaded shank 212 extended from one side of the head 211. The second connecting screw member 22 in this embodiment is a female screw member comprising a screw hole 221 at its one end and a stem 222 at its other end. The stem 222 of the second connecting screw member 22 extends in a parallel manner relative to the stop rod 11 of the support member 10. The first connecting screw member 21 is inserted through the washer 23 and the sliding member 24 and then fastened up the first connecting screw member 21 with the second connecting screw member 22 so that the first connecting screw member 21 and the second connecting screw member 22 are retained at two opposite lateral sides of the sliding slot 12. At this time, the washer 23 is stopped outside the sliding slot 12, and the sliding member 24 that has a smoothly circular outer perimeter is rotatably accommodated in the sliding slot 12.

The handle 30 is pivotally coupled to the support member 10 between the stop rod 11 and the sliding slot 12 so that the handle 30 can be biased relative to the support member 10. In this embodiment, the handle 30 is pivotally coupled to the support member 10 by a screw bolt 50 and a nut 51. Other equivalent devices can be selectively used to pivotally couple the handle 30 and the support member 10 together. Further, the handle 30 comprises a limit slot 31 adjacent to its pivoted point (the location of the screw bolt 50 and the nut 51) for accommodating the head 211 of the first connecting screw member 21. Further, the limit slot 31 defines opposing first stop wall 32 and second stop wall 33, and opposing first connection wall 34 and second connection wall 35 that are respectively connected between the first stop wall 32 and the second stop wall 33 at two opposite sides. Further, the first stop wall 32 and the second stop wall 33 are kept in a non-parallel manner. The first connection wall 34 is disposed adjacent to the coupling area between the support member 10 and the handle 30. Further, the wall length of the first connection wall 34 is longer than the second connection wall 35. The first stop wall 32 and the second stop wall 33 are adapted to selectively support the head 211 of the first connecting screw member 21, limiting the pivoting range between the support member 10 and the handle 30.

The elastic member 40 is stopped between the support member 10 and the movable device 20. In this embodiment, the elastic member 40 is a tensile spring, having its one end connected to the nut 51 (or the screw bolt 50) between the support member 10 and the handle 30 and its other end hooked in a hook hole 223 at the periphery of the second connecting screw member 22 of the movable device 20. Thus, the elastic member 40 normally holds the movable device 20 at one end of the sliding slot 12 adjacent to the coupling area between the support member 10 and the handle 30.

Figure 6:
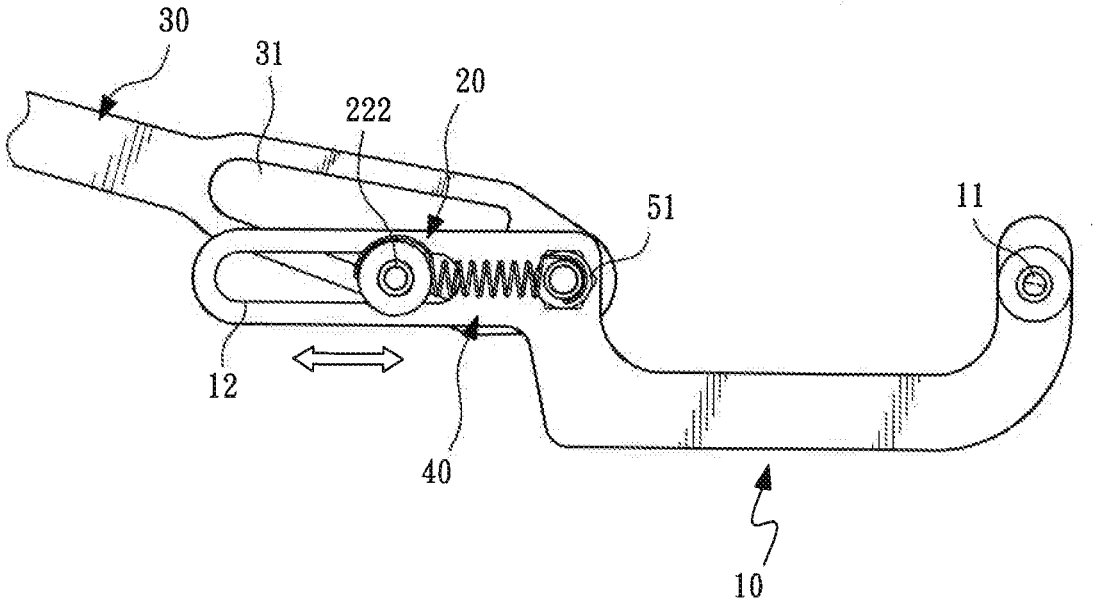
FIG. 6 is a schematic drawing illustrating an operation status of the auxiliary tool for timing gear in accordance with the present invention.

FIG. 6 illustrates an operation status of the auxiliary tool for timing gear in accordance with the present invention. As illustrated, when the elastic member 40 is in its normal position, the movable device 20 is kept at one end of the sliding slot 12 adjacent to the coupling area between the support member 10 and the handle 30. When an external force is applied to push the movable device 20 away from one end of the sliding slot 12 adjacent to the coupling area between the support member 10 and the handle 30 toward the other end of the sliding slot 12, the elastic member 40 is stretched. At this time, the stem 222 of the movable device 20 is moved far from the stop rod 11. On the contrary, when the external force is disappeared, the elastic potential energy of the elastic member 40 returns the movable device 20, moving the stem 222 in direction toward the stop rod 11.

Figure 7:
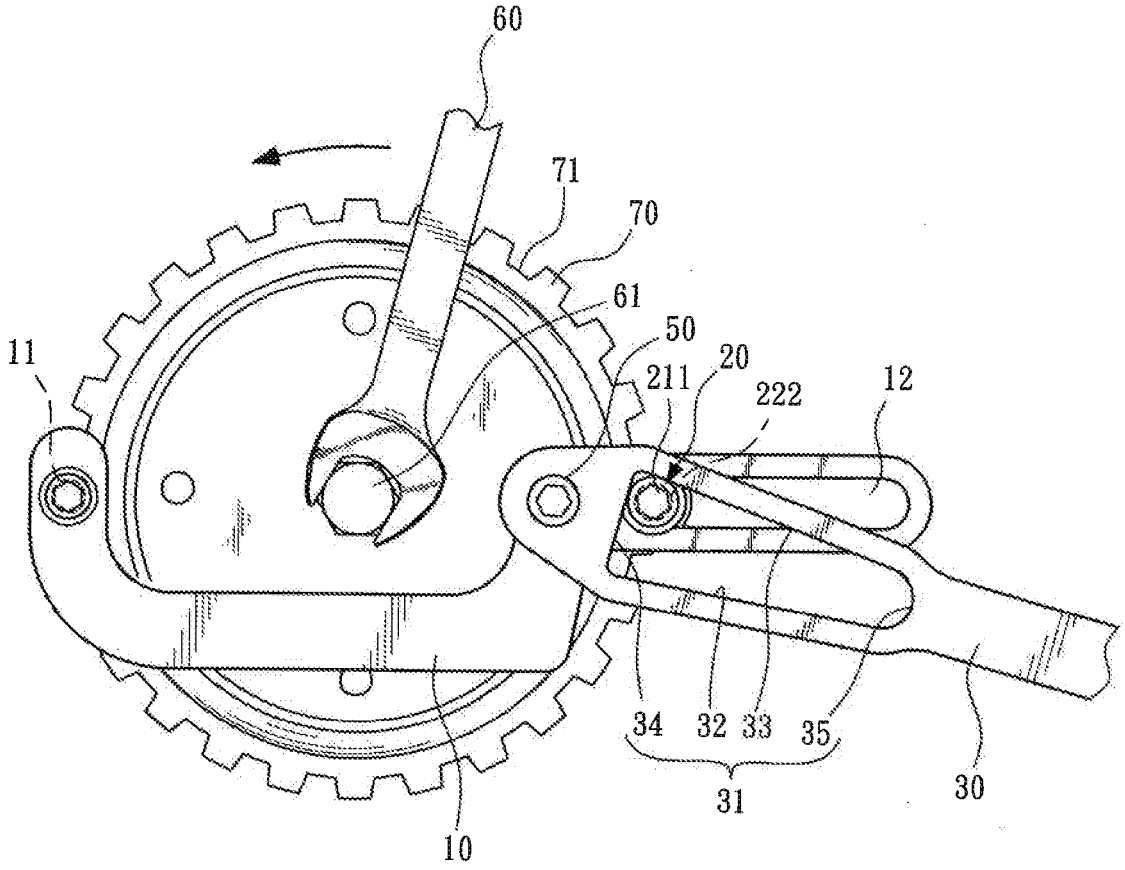
FIG. 7 is a schematic applied view of the present invention, illustrating the operation of the auxiliary tool to remove a timing gear.

FIG. 7 illustrates an application example of the auxiliary tool to remove a timing gear. During this operation, the stop rod 11 of the support member 10 and the stem 222 of the movable device 20 are engaged into respective peripheral notches 71 of the timing gear 70. When operating a wrench 60 to loosen the screw bolt 61 from the timing gear 70, the stop rod 11 and the stem 222 stop the timing gear 70 from rotation, allowing the screw bolt 61 to be loosened to dismount the timing gear 70. Further, when rotating the screw bolt 61 counter-clockwise, the handle 30 is rotated clockwise relative to the support member 10 to stop the head 211 of the first connecting screw member 21 of the movable device 20 against the second stop wall 33 in the limit slot 31, prohibiting the timing gear 70 from rotation with the screw bolt 61 in the counter-clockwise direction.

Figure 8:
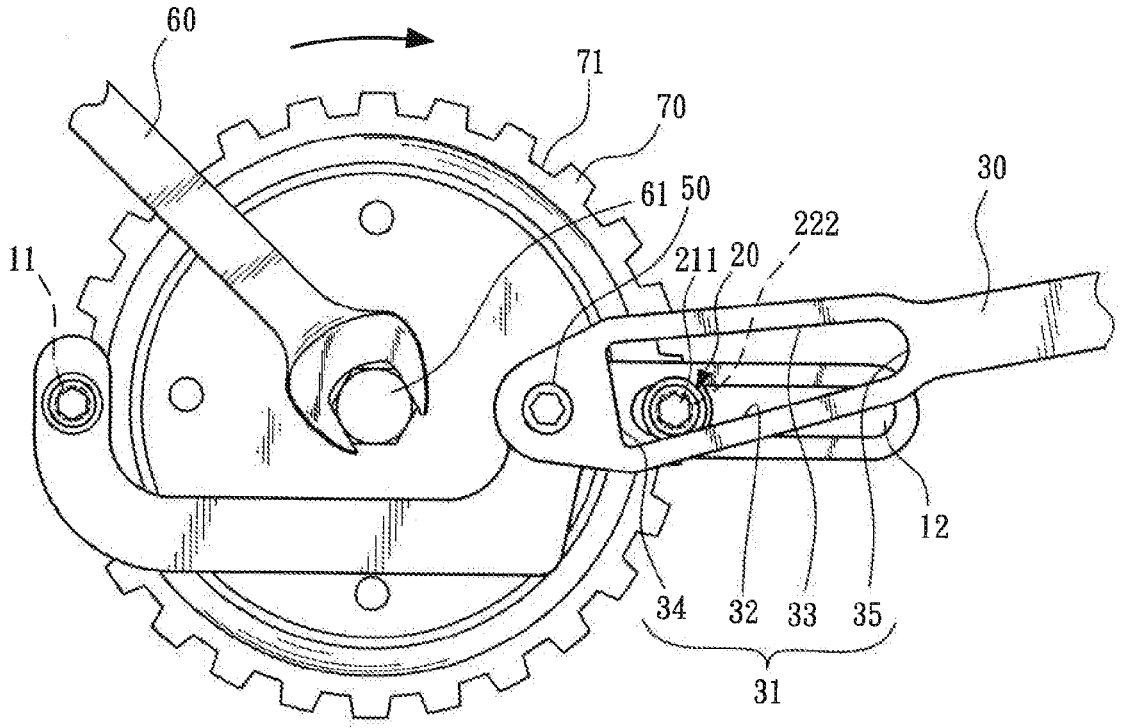
FIG. 8 is a schematic applied view of the present invention, illustrating the operation of the auxiliary tool to fasten tight a small timing gear.

FIG. 8 illustrates an application example of the auxiliary tool to fasten tight a small timing gear. As illustrated, to facilitate operating the wrench 60 in rotating the screw bolt 61 clockwise and fastening tight the screw bolt 61, the stop rod 11 of the support member 10 and the stem 222 of the movable device 20 are engaged into respective peripheral notches 71 of the timing gear 70, and then the handle 30 is biased in the counter-clockwise direction relative to the support member 10 to stop the head 211 of the first connecting screw member 21 of the movable device 20 against the first stop wall 32 in the limit slot 31, prohibiting the timing gear 70 from rotation with the screw bolt 61 in the clockwise direction. At this time, the user can operate the wrench 60 to rotate the screw bolt 61 in the clockwise direction positively and to further fasten tight the screw bolt 61.

Thus, either mounting or dismounting the timing gear 70, the user needs not to reverse the auxiliary tool. Thus, the design of the auxiliary tool having only one single stop rod 11 at the support member 10 and one single stem 222 at the movable device 20 is sufficient to achieve the desired effects. When compared to conventional tools, the invention has the advantage of convenience in use.

Figure 9:
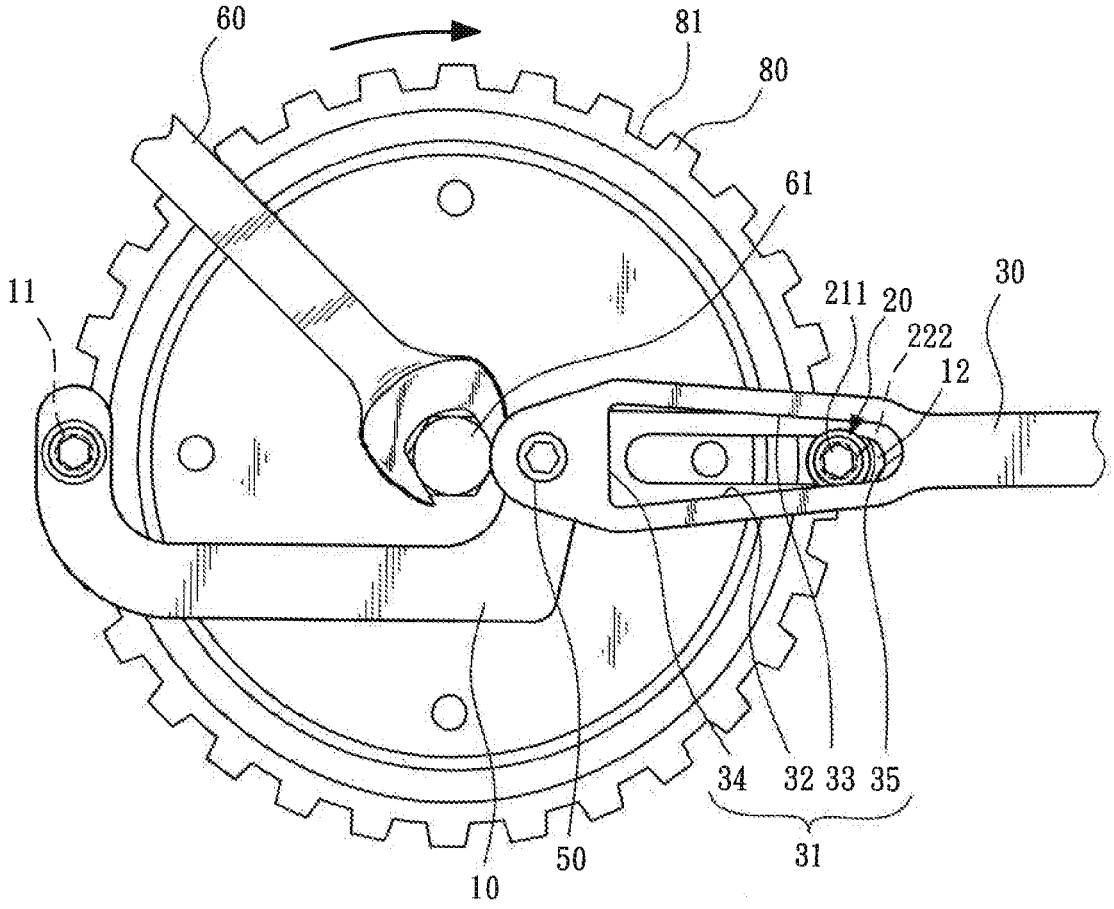
FIG. 9 is a schematic applied view of the present invention, illustrating the operation of the auxiliary tool to fasten tight a large timing gear.

FIG. 9 illustrates another application example of the auxiliary tool to fasten tight a large timing gear. During this application, the movable device 20 is slidably accommodated in the sliding slot 12 for allowing adjustment of the distance between the stop rod 11 and the step 222. Thus, the stop rod 11 of the support member 10 and the stem 222 of the movable device 20 can be conveniently engaged into respective peripheral notches 81 of a large timing gear 80, allowing operation of the wrench 60 to rotate the screw bolt 61 positively. By means of moving the movable device 20 to stretch the elastic member 40, the distance between the stop rod 11 and the step 222 is adjusted, allowing the movable device 20 be stopped at the periphery of the large timing gear 80. Thus, the auxiliary tool of the invention fits different timing gears 70;80 of different diameters.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An auxiliary tool for timing gear, comprising:

a support member comprising a transversely extending stop rod at one end thereof and a longitudinally extending sliding slot at an opposite end thereof;

a movable device mounted in and movable along said sliding slot, said movable device comprising a stem located at one end thereof and disposed in a parallel manner relative to said stop rod for working with said stop rod to engage into peripheral notches of a timing gear at two opposite sides during application; and a handle pivotally coupled to said support member, said handle comprising a longitudinally extending limit slot for accommodating an opposite end of said movable device to limit pivoting movement between said support member and said handle within a predetermined range.

2. The auxiliary tool for timing gear as claimed in claim 1, further comprising an elastic member connected between said support member and said movable device.

3. The auxiliary tool for timing gear as claimed in claim 2, wherein aid elastic member is a tensile spring.

4. The auxiliary tool for timing gear as claimed in claim 3, wherein said elastic member has one end thereof fixedly connected to a coupling area between said support member and said handle and an opposite end thereof hooked on a periphery edge of said movable device.

5. The auxiliary tool for timing gear as claimed in claim 1, wherein said movable device comprises a first connecting screw member and a second connecting screw member fastened together and disposed at two opposite sides of said sliding slot, said first connecting screw member comprising a head accommodated in said limit slot, said second connecting screw member having a part thereof terminating in said stem.

6. The auxiliary tool for timing gear as claimed in claim 5, wherein said movable device further comprises a sliding member coupled between said first connecting screw member and said second connecting screw member and rotatably accommodated in said sliding slot.

7. The auxiliary tool for timing gear as claimed in claim 1, wherein said limit slot defines therein opposing first stop wall and second stop wall for selectively stopping against said stem.

8. The auxiliary tool for timing gear as claimed in claim 7, wherein said first stop wall and said second stop wall are arranged in a non-parallel manner.

9. The auxiliary tool for timing gear as claimed in claim 8, wherein said limit slot further defines therein opposing first connection wall and second connection wall respectively connected between said first stop wall and said second stop wall at two opposite sides, said first connection wall being disposed adjacent to the coupling area between said support member and said handle.

10. The auxiliary tool for timing gear as claimed in claim 9, wherein said first connection wall has a length longer than said second connection wall.

* * * * *